US005950901A

United States Patent [19]

Kubota

[11] Patent Number: 5,950,901

[45] Date of Patent: Sep. 14, 1999

[54] SECURING-PIECE ATTACHING APPARATUS

[75] Inventor: Mikio Kubota, Tokyo, Japan

[73] Assignee: Toska Co., Ltd., Tokyo, Japan

[21] Appl. No.: 08/912,850

[22] Filed: Aug. 19, 1997

[30] Foreign Application Priority Data

Aug. 23, 1996 [JP] Japan ..... 8-222237

[51] Int. Cl.[6] ..... B65C 5/06

[52] U.S. Cl. ..... 227/71; 227/67; 227/72

[58] Field of Search ..... 227/71, 67, 132, 227/134, 72, 18, 143; 29/235

[56] References Cited

U.S. PATENT DOCUMENTS

| | | | |
|---|---|---|---|
| Re. 34,857 | 2/1995 | Kunreuther | 227/71 |
| 3,734,375 | 5/1973 | Bone | 227/67 |
| 3,875,648 | 4/1975 | Bone | 227/71 |
| 3,901,428 | 8/1975 | Grass | 227/67 |
| 4,416,407 | 11/1983 | Bone | 227/67 |
| 4,536,933 | 8/1985 | Furutsu | 29/235 |
| 4,683,635 | 8/1987 | Duchin | 29/432 |
| 4,877,172 | 10/1989 | Franklin | 227/67 |
| 5,471,727 | 12/1995 | Kubota | 29/235 |
| 5,501,002 | 3/1996 | Fukami | 29/811.2 |
| 5,785,230 | 7/1998 | Davignon | 227/71 |

*Primary Examiner*—Peter Vo
*Assistant Examiner*—James P. Calve
*Attorney, Agent, or Firm*—Nikaido, Marmelstein, Murray & Oram LLP

[57] ABSTRACT

Two transverse rod portions of a securing piece having the transverse rod portion at the both ends of a filament portion respectively are simultaneously driven through hollow needles 22 and 22 while journaling one end of a lever 13 so as to approach or separate from a grip portion 12 formed on a body 11 by oscillating, journaling one end of a support table 14 having a bottom support table 14*a* at the bottom of the body 11, making the front of the support 14 approach or separate from the body 11 by interlocking with the lever 13 and oscillating, and inserting two hollow needles 22 and 22 provided for the bottom of the body 11 into two needle holes 21 and 21 opened in the bottom support table 14*a* and moreover, an object 7 to be fixed is fixed to an object 6 to be worked by operating the lever 13 while mounting the object 6 to be worked and the object 7 to be fixed on the bottom support table 14*a*.

4 Claims, 10 Drawing Sheets

SECURING-PIECE ATTACHING APPARATUS

TECHNICAL FIELD

The present invention relates to a securing-piece attaching apparatus for attaching an object to be attached such as a label to a commodity such as clothing by simultaneously driving two transverse rod portions of a securing piece (double-rod-type securing piece) constituted by providing a T-shaped transverse rod portion for the both ends of a filament portion and forming the T-shaped transverse rod portions into an H shape as a whole into adjacent portions and forming the filament portion into an inverse-U shape and moreover, relates to a securing-piece attaching apparatus capable of attaching a normal securing piece having one transverse rod portion to an object.

BACKGROUND ART

A securing piece normally referred to as a tag pin is widely used to attach a price tag to a commodity, attach a label to various commodities or animals, or put together two or more commodities including footwear.

The securing piece comprises a flat head portion, a filament portion perpendicularly intersecting the middle of the head portion and extending in one direction, and transverse rod portions arranged at the ends of the filament portion in parallel with the head portion. The entire securing piece is integrally made of a synthetic resin. Moreover, when manufacturing the securing piece, 100 to 200 securing pieces are connected to each other on one connective rod through a connective portion which extends on the extension line of the filament portion from the transverse rod portions and can be cut and integrally formed as an assembly of 100 to 200 securing pieces.

The securing piece made of a synthetic resin is used instead of a yarn conventionally used to attach a price tag to a commodity such as clothing, which is widely used to attach a label to many commodities because it is superior in the fact that a price tag can be easily attached to a commodity by gripping the lever of a setting apparatus.

However, because a price tag attached to a commodity by using the normal securing piece is suspended by one filament portion and removal-prevented by the head portion, it freely moves and its direction is not determined. Therefore, this label cannot be used for a purpose of exactly fixing the label as if it is stuck to a commodity.

Moreover, as a modification of the securing piece for a price tag, the official gazette of Japanese Patent Publication No. 28619/1983 or Japanese Utility Model Publication No. 1043/1986 discloses a securing piece having a double-rod structure constituted by using a transverse rod portion instead of a head and setting the transverse rod portion to the both sides of a filament portion to form the whole into an H shape and the double-rod-type securing piece can be used when passing a transverse rod portion through two holes of a button, inserting the portion into the lower side of a dress, bending the filament portion into an inverted-U shape, and setting the button to the dress.

The double-rod-type securing piece disclosed in the above official gazette of Japanese Patent Publication No. 28169/1983 is constituted by long continuing transverse rod portions at the both sides of the securing piece and connecting filament portions like a ladder between the transverse rod portions at a predetermined interval. To attach the securing piece to an object by an attaching apparatus, it is necessary to cut the continuous transverse rod portions into each transverse rod portion. Therefore, the structure of the attaching apparatus becomes complex.

Therefore, the attaching apparatus is mainly applied to a fixed-type large apparatus such as a sewing machine. However, the attaching apparatus cannot be easily operated because it is too large. Moreover, the official gazette also discloses a manual apparatus. However, the apparatus is not suitable for an operation of driving a securing piece while supporting the back of a commodity because the apparatus is used by inserting a hollow needle from one side of a commodity.

Moreover, the apparatus disclosed in the official gazette of Japanese Utility Model Publication No. 1043/1986 also uses a ladder-like double-rod-type securing piece. However, the apparatus has an extremely bad operability as a portable type because the apparatus uses a large specific screw mechanism as a feed mechanism so as to guide a filament portion to the screw mechanism by bending the filament portion into a U shape and thereby, the apparatus is extremely complex and moreover, inevitably becomes large.

However, when securing a label made of cloth, paper, or leather to a jean, canvas product, or fabric by driving a double-rod-type securing piece into four corners of the label as if the tag were sewed, the tissue of the jean is very hard and dense compared to that of a normal fabric for clothing. When inserting two hollow needles having a diameter of 1.8 to 2.0 mm and arranged in parallel, the resistance is extremely large compared to the case of the normal fabric for clothing and therefore, it is absolutely impossible to perform continuous operations by a manual attaching apparatus.

Therefore, to attach a label made of cloth of leather to a Jean or canvas which is harder than the texture of normal clothing, a method of sewing the jean or canvas by a stapler for office work or an industrial sewing machine using a thick yarn is used. In the case of the method of using a stapler, it is necessary to sew a Jean while rolling up the end of the Jean by hand. Therefore, it is difficult to press the stapler, thereby, it is impossible to drive a stapler needle into an accurate position, and it is difficult to attach the label to a predetermined position.

Moreover, it is difficult to perform the above troublesome manual operation using a metallic stapler requiring a gripping force for a long time continuously. Furthermore, the stapler needle has problems that it cuts fibers and damages a commodity when it is driven into the commodity and it produces rust while it is stored for a long time to extremely deteriorate the quality of the commodity.

Furthermore, the method of sewing a jean by applying the jean to a large double-rod-type securing-piece attaching apparatus such as an industrial sewing machine has problems that the operability is deteriorated and the operation for attaching a label can be performed at only a predetermined place where the attaching apparatus is set.

In the case of the method of sewing a label on clothing or the like by using a thick yarn, an attaching position of the label can be optionally selected and an operation place is not restricted. However, this is a manual operation and moreover, it is impossible to attach the label to an inaccessible position at the back of cloth. Therefore, there is a problem that it is absolutely impossible to continuously and efficiently attach a lot of labels.

It is a first object of the present invention to provide a twin-type securing-piece attaching apparatus capable of solving, at a stroke, the problems with a button attaching apparatus using a conventional double-rod-type securing piece made of a synthetic resin, an apparatus for attaching a label by driving stapler needles, and a method of sewing a label on an object with a thick yarn.

Moreover, it is a second object of the present invention to provide a securing-piece attaching apparatus capable of attaching even a securing piece used to attach a normal price tag by using the attaching apparatus.

DISCLOSURE OF THE INVENTION

A securing-piece attaching apparatus of the present invention for achieving the above objects is constituted as described below.

(1) The apparatus is constituted so as to support a lever 13 so that the lever 13 approaches or separates from a grip portion 12 formed on a body 11, journals an end of a support table 14 having a bottom support table 14*a* at the bottom of the body 11, make the support table 14 approach or separate from the body 11 by interlocking with the lever 13, and simultaneously drive two transverse rod portions of a securing piece into the both ends of a filament portion through two hollow needles 22 and 22 set at the bottom of the body 11 while inserting the needles 22 and 22 into two needle holes 21 and 21 opened on the bottom support table 14*a*.

(2) The apparatus is provided with a securing-piece driving mechanism having a transverse rod portion at the both ends of a filament portion for supporting the lever 13 so as to approach or separate from a grip portion 12 formed on the body 11, journaling one end of the support table 14 having the bottom support table 14*a* at the bottom of the body 11, and comprising a lever 23 interlocking with the lever 13, rod levers 26 and 26 interlocking with the lever 23, pistons 32 and 32 interlocking with the rod levers 26 and 26, feed gears 35 and 35 provided in parallel with the moving path of the pistons 32 and 32, an oscillator 30 to be oscillated at the raised and lowered positions of the pistons 32 and 32, feed pawls 30*d* and 30*d* whose one ends are secured to the oscillator 30 and whose other ends are engaged with the gears 35 and 35, and stoppers 31 and 31 for preventing the feed gears 35 and 35 from reversing.

(3) The securing-piece driving mechanism is constituted so that the mechanism is able to drive a securing piece having a head at one end of a filament, and one transverse rod portion at the other end of the filament, or a double-rod-type securing piece having a transverse rod portion at the both ends of the filament portion.

(4) A loading port 20 for loading a securing piece group is opened upward at the front of the body 11 and constituted so that the security piece group is guided up to the entrance of the hollow needles 22 and 22 by being guided by a curved-surface path formed at the front of the body 11.

BEST MODE FOR CARRYING OUT THE INVENTION

Then, an embodiment of the present invention is described below by referring to the accompanying drawings.

(A) First, a double-rod-type securing piece and its driving method of the present invention are described.

Figure 1:
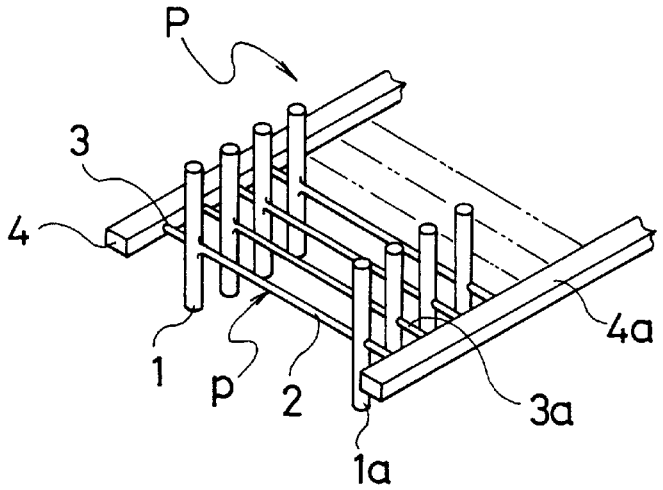
FIG. 1 is a perspective view showing a double-rod-type securing piece group having a transverse rod portion at the both ends of a filament.

As shown in FIG. 1, a double-rod-type securing piece p is formed into an H shape by providing transverse rod portions 1 and 1*a* for the both sides of a filament portion 2 and a ladder-like rouble-rod-type securing piece group P is constituted as a whole by connecting connective members 4 and 4*a* (serving as runner portions for guiding a melted resin) through connective portions 3 and 3*a* extending on the extension line of the filament portion 2. The double-rod-type securing piece group P is an assembly constituted by putting 100 to 200 double-rod-type securing pieces p together and is integrally formed by using a filamentary synthetic resin such as nylon or polypropylene which can be extended and whose strength increases as the resin is further extended.

To attach a label to cloth or fabric like a Jean or sheet-like object by using the above double-rod-type securing piece group P, a label 7 is mounted on a jean 6 to insert the double-rod-type securing piece group P into an attaching apparatus to be described later and thrust two hollow needles (symbol 22 in FIG. 4) provided for the front of the attaching apparatus up to the back of the jean 6.

Then, one double-rod-type securing piece p located at the front end of the securing piece group P is separated from the double-rod-type securing piece group P by operating the lever (symbol 13 in FIG. 4) of the attaching apparatus or a motor of the attaching apparatus when it is motor-driven by disconnecting the connective portions 3 and 3*a* from the connective members 4 and 4*a*. One double-rod-type securing piece p thus separated is fed to the rear (entrance) of the two hollow needles provided for the front of the attaching apparatus and under this state, the axis of the transverse rod portion is oriented onto the extension line of the axis of the hollow needle.

Then, two pistons (symbol 32 in FIG. 7) simultaneously advance through the lever operation, push the rears of the transverse rod portions 1 and 1*a*, communicate with and enter the hollow needles to advance them, pass the filament portion 2 through slits opened at the sides of the hollow needles, and moreover eject the transverse rod portions 1 and 1*a* from the ejection ports provided for the sides of the front ends of the hollow needles at the end position of the piston stroke to complete the driving of the double-rod-type securing piece p.

Figure 2:
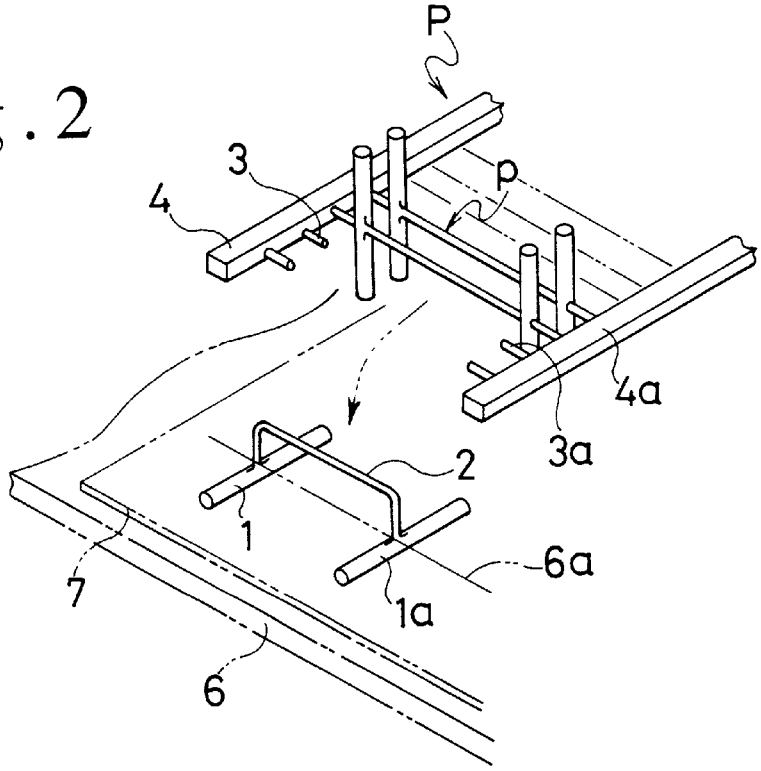
FIG. 2 is an illustration for explaining the state of driving one securing piece from the securing piece group in FIG. 1.

FIG. 2 shows a state in which the transverse rod portions 1 and 1*a* are located along a back 6*a* of the jean 6 by ejecting the transverse rod portions 1 and 1*a* at the back of the jean 6. In this case, the filament portion 2 is formed into an inverted-U shape to press the label 7 mounted on the jean 6 against the surface of the jean 6.

(B) Details of securing-piece attaching apparatus

Figure 3:
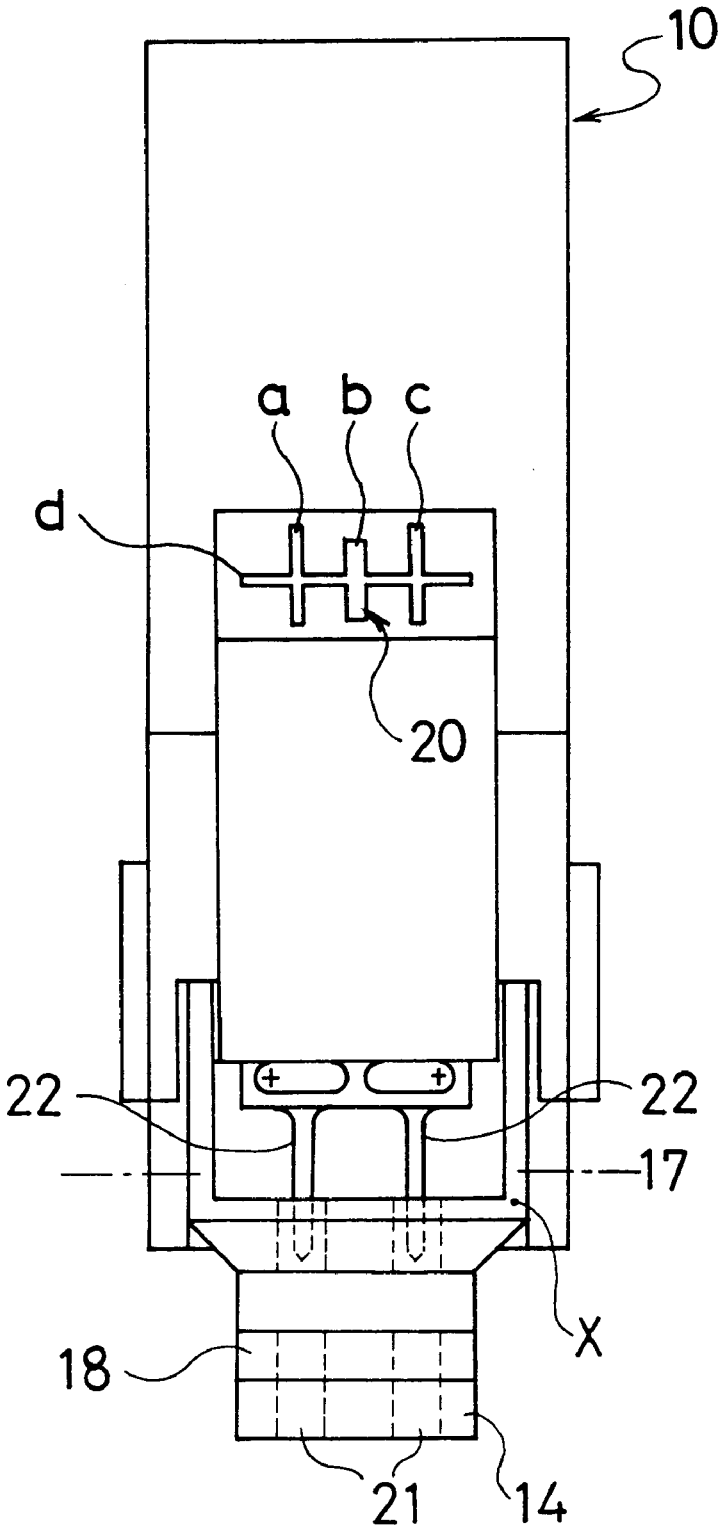
FIG. 3 is a front view of the securing-piece attaching apparatus of an embodiment of the present invention.
Figure 4:
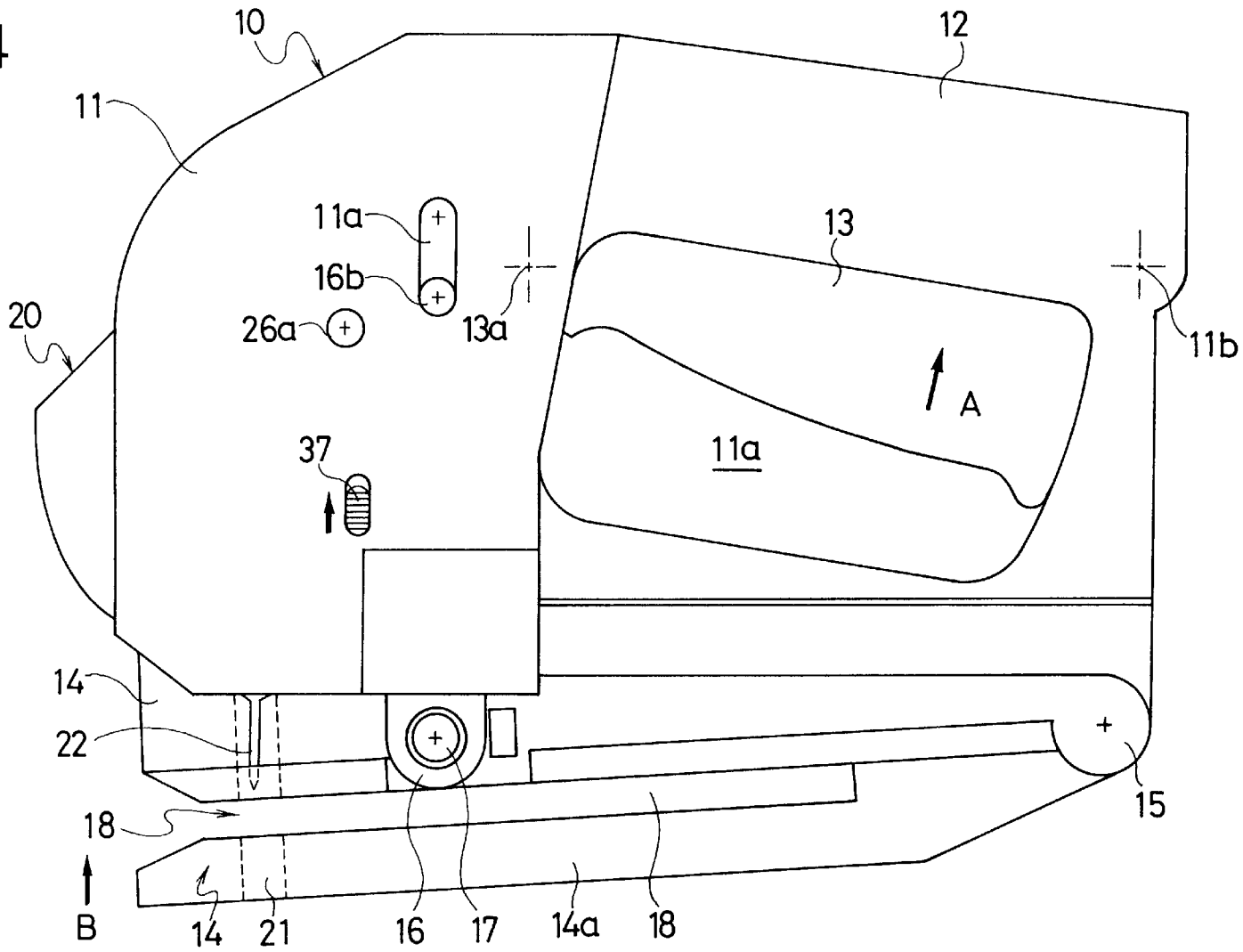
FIG. 4 is a side view of the securing-piece attaching apparatus in FIG. 3.
Figure 5:
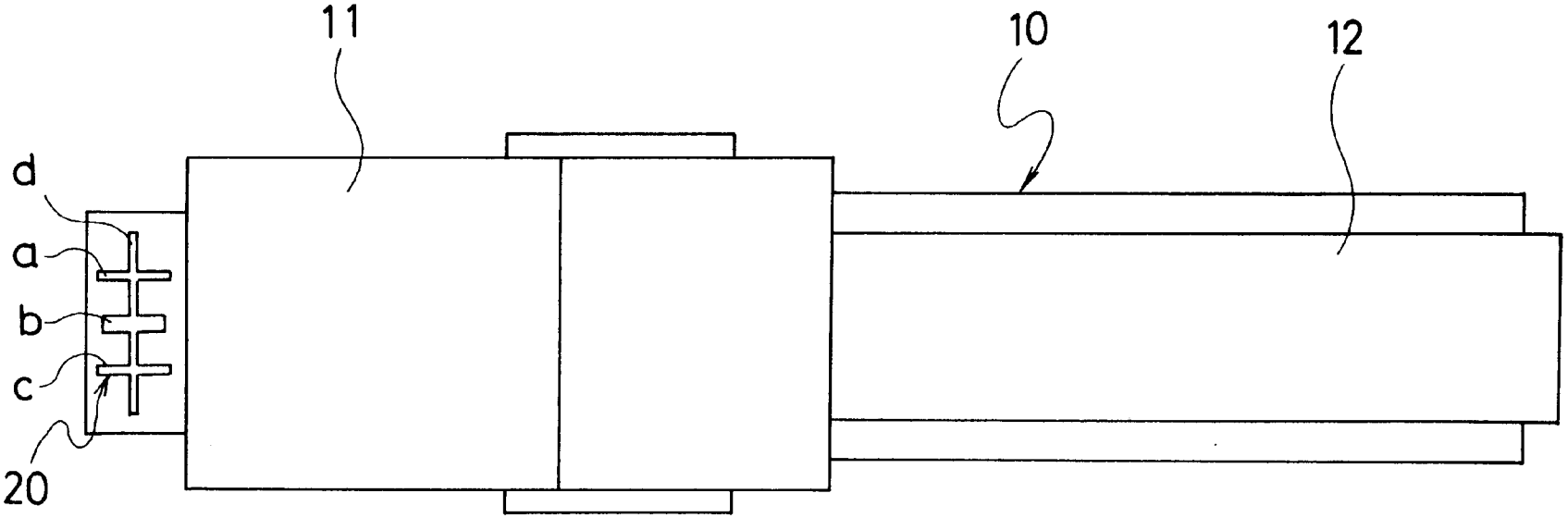
FIG. 5 is a top view of the securing-piece attaching apparatus in FIG. 3.
Figure 6:
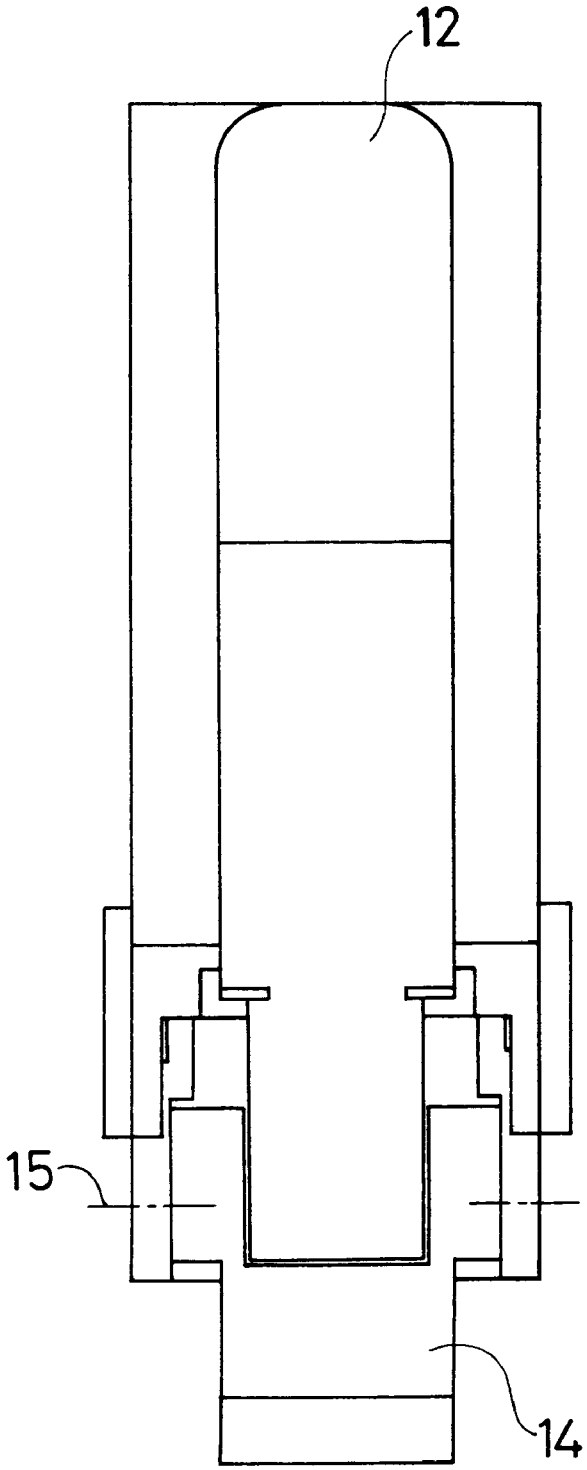
FIG. 6 is a back view of the securing-piece attaching apparatus in FIG. 3.

FIG. 3 is a front view of a double-rod-type securing-piece attaching apparatus of the present invention, FIG. 4 is a side view of the attaching apparatus in FIG. 3, FIG. 5 is a top view of the attaching apparatus in FIG. 3, and FIG. 6 is a back view of the attaching apparatus in FIG. 3.

An attaching apparatus 10 is a member mainly comprising synthetic-resin molded parts, which is formed like an iron as a whole by forming the grip portion 12 at the top margin of a window 11*a* shown in FIG. 4 opened at a slightly rear portion of the body 11 to support the lever 13 under the grip portion 12 so that the rear of the lever 13 vertically oscillates about a spindle 13*a* provided for the front of the lever 13.

Moreover, the support table 14 is supported under the body 11 so as to oscillate its front about a spindle 15 provided for the rear of the table 14. By holding the lever 13 upward as shown by the arrow A in FIG. 7, the front of the support table 14 is raised upward as shown by the arrow B through a connective rod 16 with which the bottom end of a connective shaft 17 provided for the support table 14 side is engaged to drive a double-rod-type securing piece.

Figure 7:
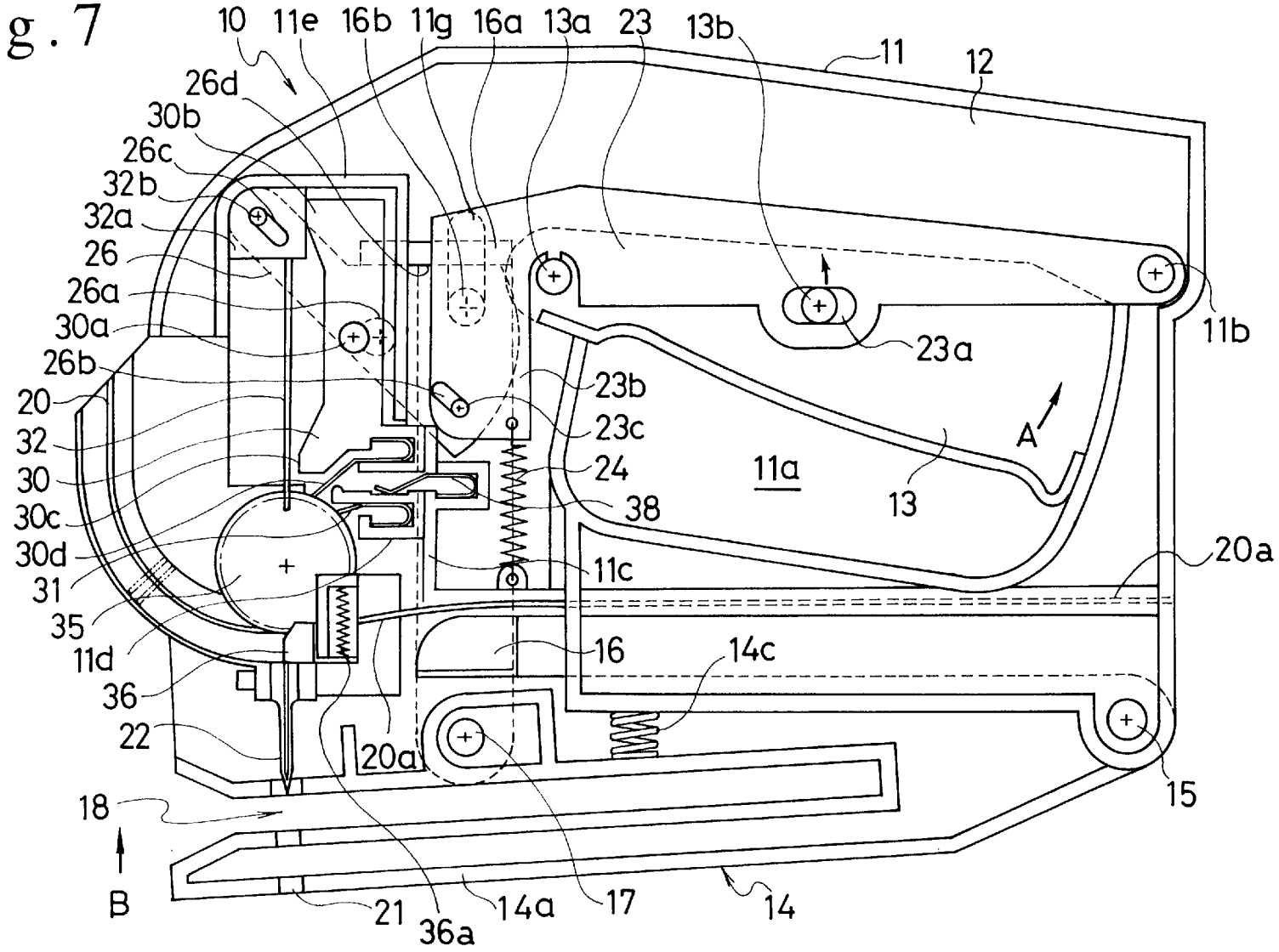
FIG. 7 is a transverse sectional view showing the internal structure of a securing-piece attaching apparatus.

Moreover, the support table 14 has an oblong U shape as a whole as shown in FIG. 7 and an acceptance port 18 opening at the front of the table 14 is formed like a slit so that operations are performed by inserting a commodity such as a Jean to which a label is attached into the acceptance port 18.

As shown in FIGS. 3 and 5, a loading port 20 for the double-rod-type securing piece group P is opened on the upper face of the front of the body 11 and moreover, two hollow needles 22 and 22 are protruded to the lower face of the body 11 above two needle holes 21 and 21 formed by vertically passing through the support table 14. Furthermore, as described above, by holding the lever 13 in the direction of the arrow A, the front of the support table 14 is raised to the body 11 side in the direction of the arrow B, the front ends of the hollow needles 22 and 22 are inserted into the needle holes 21 and 21, and the hollow needles 22 and 22 are inserted into a Jean or the like. Moreover, a spring 14*c* (FIG. 7) is set between the body 11 and the support table 14 and thereby, the support table 14 is returned to a predetermined position of the body 11.

(C) Internal structure of securing piece attaching apparatus

Figure 8:
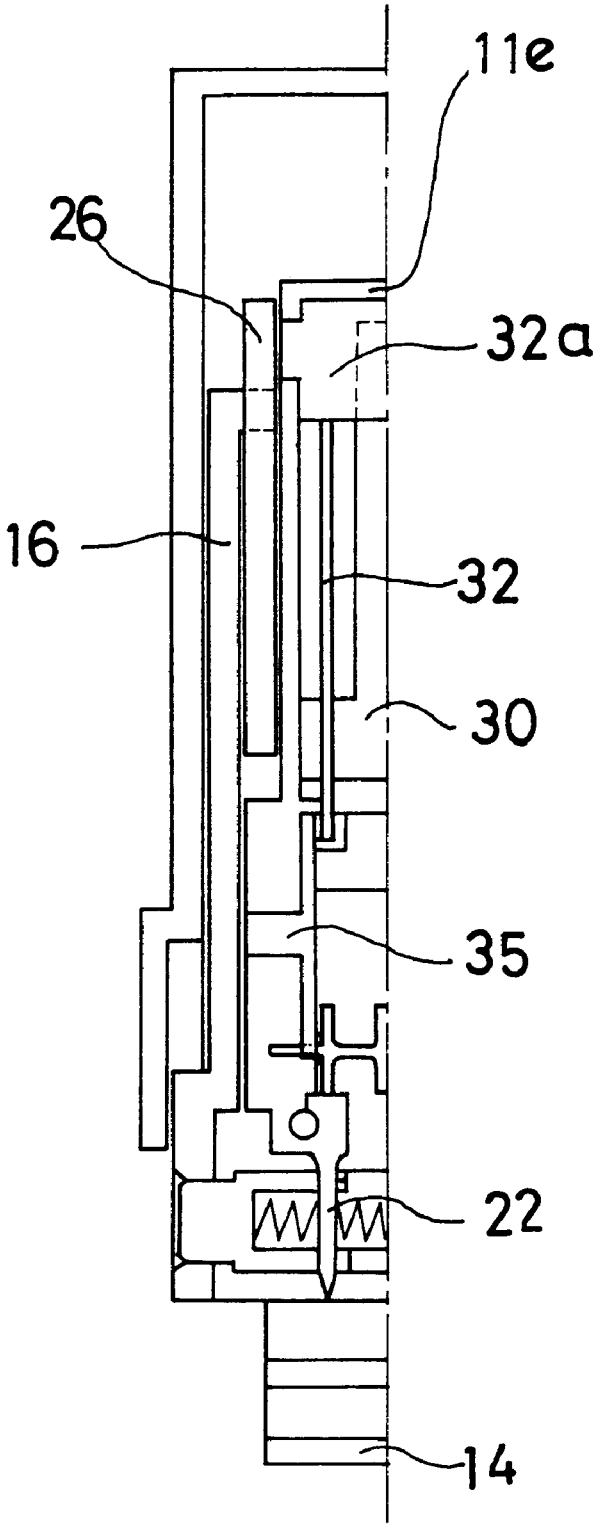
FIG. 8 is a front sectional view of the securing-piece attaching apparatus in FIG. 7.
Figure 9:
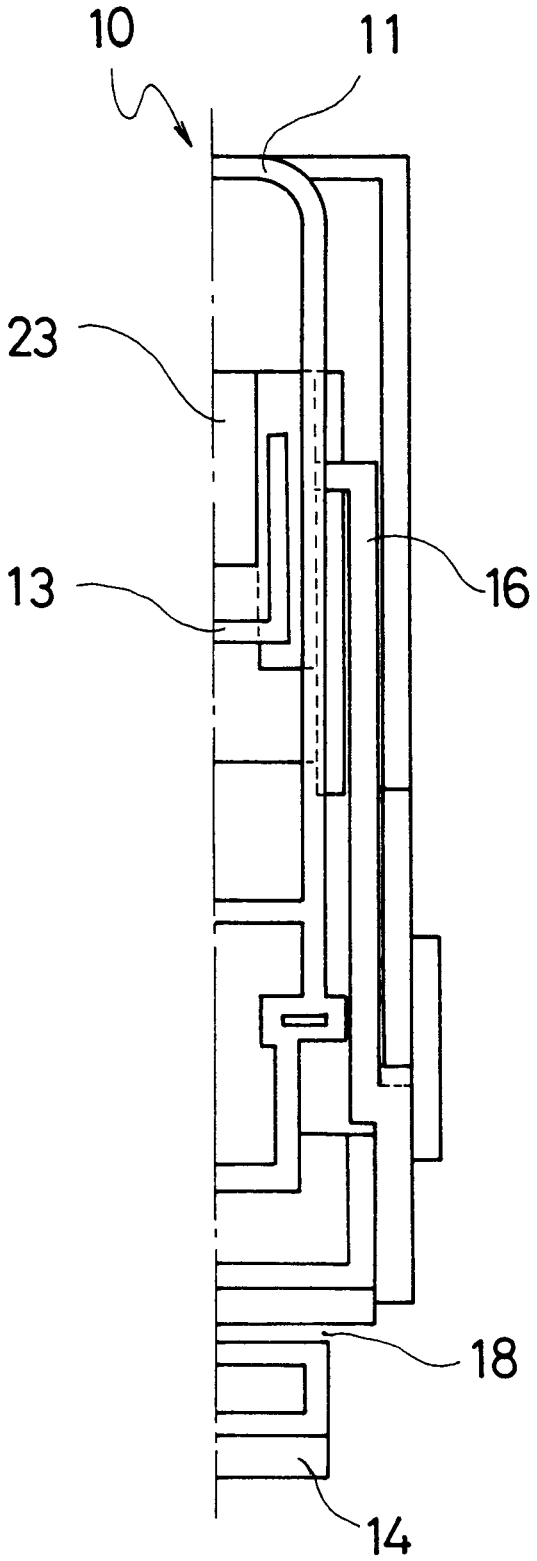
FIG. 9 is a back sectional view of the securing-piece attaching apparatus in FIG. 7.

FIG. 7 is a side view showing the internal structure of attaching apparatus 10 after removing the side plate, FIG. 8 is a front sectional view showing an essential member, and FIG. 9 is a sectional view viewed from the rear of the essential member.

The body 11 is formed to be hollow by combining right and left body members formed like a frame or box made of synthetic resin molded parts and fitted to the lever 13 so as to appear in or disappear from the window 11*a* under the grip portion 12. Moreover, the lever 13 is journaled by fitting the spindle 13*a* provided for the front of the lever 13 to a bearing provided for the body 11. Furthermore, the lever 13 is engaged with a slot 23*a* formed at the middle portion of the lever 23 functioning as a portion for driving each member and supported by a spindle 13*b* protruded to the middle portion of the lever 13.

Figure 10:
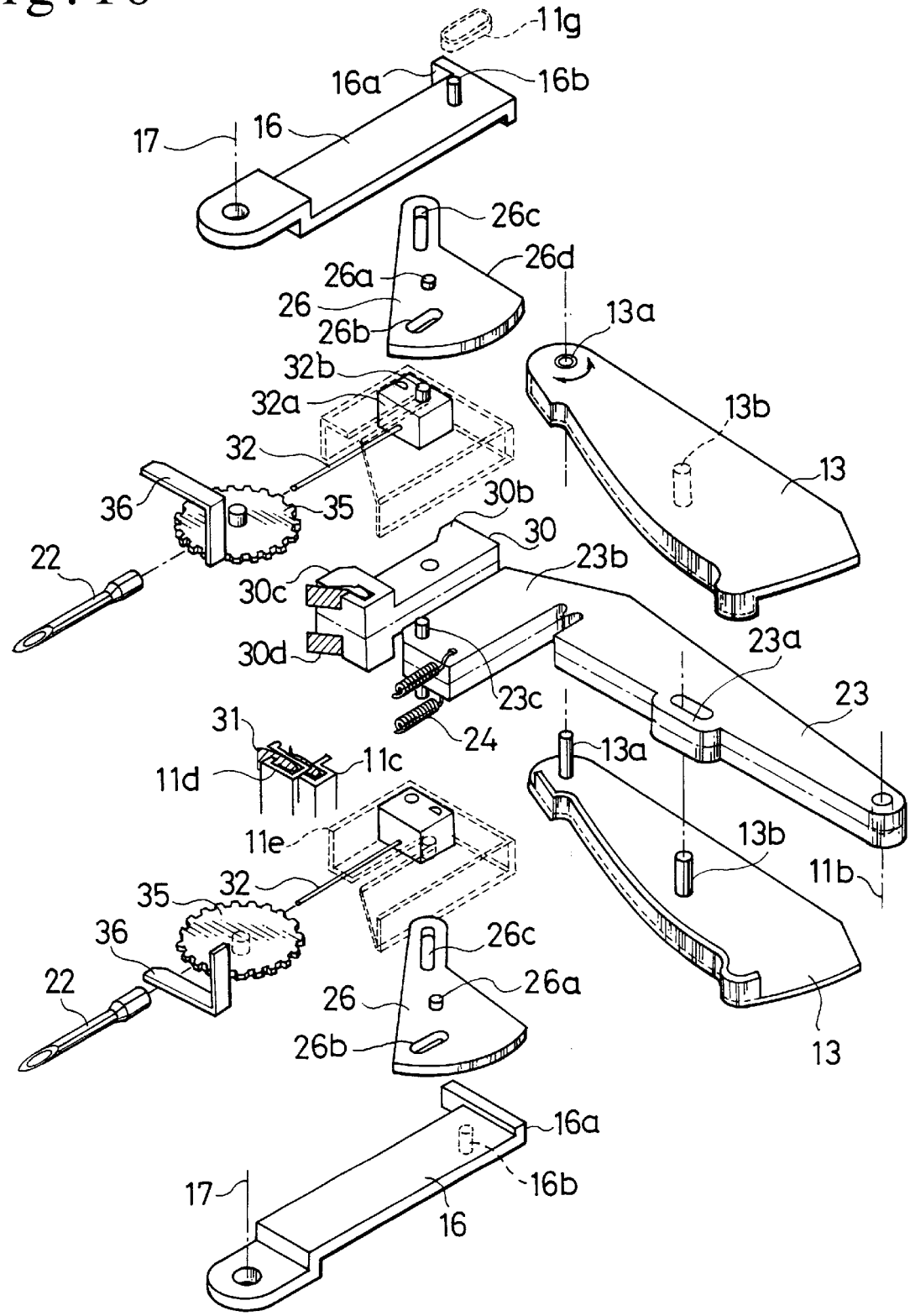
FIG. 10 is an assembly view of parts of a securing-piece attaching apparatus.

The whole of the lever 23 is formed into an L shape as shown in FIG. 10, the rear end of it is Afitted to and supported by a spindle 11*b* protruded inside of the body 11, and the front of it is secured by the spindle 13*a* as shown in FIG. 7 so as to keep a certain lowered position.

Moreover, the tensile force of a spring 24 whose bottom end is secured to a guide wall 11*c* is made to work on a front L-shaped portion 23*b*. Therefore, the front of the lever 23 rises when driving one securing piece p by holding the lever 13 and the rear of the lever 23 lowers about the rear spindle 11*b* by the action of the spring 24 when decreasing the force for holding the lever 13 after the securing piece p is driven. In this case, the lever 13 connected through the spindle 13*b* provided for the lever 13 is returned to the original position as shown in FIG. 7 and protruded into the window 11*a*.

(D) Securing-piece feed mechanism A fan-shaped rod lever 26 is set to the both sides of the front of the lever 23 so as to overlap with the front. The middle portion of the rod lever 26 is swingably supported to the body 11 by a spindle 26*a* so as to rotate the rod lever 26 about the spindle 26*a* according to the oscillation of the lever 23 by fitting a spindle 23*c* provided for the lateral of the L-shaped portion 23*b* of the lever 23 to a slot 26*b* provided for the lateral of a fan-shaped portion.

Moreover, a pressing side 16*a* is formed at the top end of the connective rod 16 for driving the support table 14 by being connected to the front of the support table 14 so as to transversely protrude and the pressing side 16*aa* engages with a top margin 26*d* of the rod lever 26 to raise the support table 14 according to the upward movement of the rod lever 26. Furthermore, a guide protrusion 16*b* is formed on the outer face of the connective rod 16 so as to accurately vertically move the connective rod 16 by fitting the protrusion 16*b* to a long groove 11*g* (FIG. 7) formed inside of the body 11.

A guide wall lie is formed inside of the body 11, the oscillator 30 is supported inside of the guide wall lie so as to oscillate about a spindle 30*a* provided for the body 11 side, cams 30*b* and 30*c* are formed at the both ends of the oscillator 30 respectively, and moreover flat-spring-shaped feed pawls 30*d* and 30*d* are provided nearby the cam 30*c* in parallel. Moreover, a flat-spring-shaped stopper 31 is secured in a spring chamber 11 *a* supported by the guide wall 11*c* formed inside of the body 11.

A substrate 32*a* of the piston 32 formed at the front end of the rod lever 26 so as to fit a pin 32*b* provided for the substrate 32*a* to a slot 26*c* formed on the rod lever 26, transfer the oscillation of the rod lever 26 to the substrate 32*a* of the piston 32, make the piston 32 linearly move toward the hollow needle 22, and insert a securing piece into the hollow needle 22.

The pistons 32 and 32 are members for inserting the transverse rod portions 1 and 1*a* of the double-rod-type securing piece p into the entrances of the hollow needles 22 and 22 and constituted so as to insert the transverse rod portions 1 and 1*a* sent to the entrances through the loading port 20 into the hollow needles 22 and 22 and eject them from the front ends of the needles 22 and 22. Moreover, during the above operation, the filament portion 2 connecting the transverse rod portions 1 and 1*a* each other passes through slits opened at the laterals of the hollow needles 22 and 22.

(E) Method for operating securing-piece attaching apparatus (a) The double-rod-type securing piece group P shown in FIG. 1 or a securing piece group normally having one transverse rod portion is loaded to the loading port 20 opened at the front of the body 11 of the securing-piece attaching apparatus 10 shown in FIGS. 3, 5, and 7. The connective portions 3 and 3*a* of the securing piece p at the front end of the securing piece group P are engaged with the gear 35 at the both sides respectively.

Figure 11:
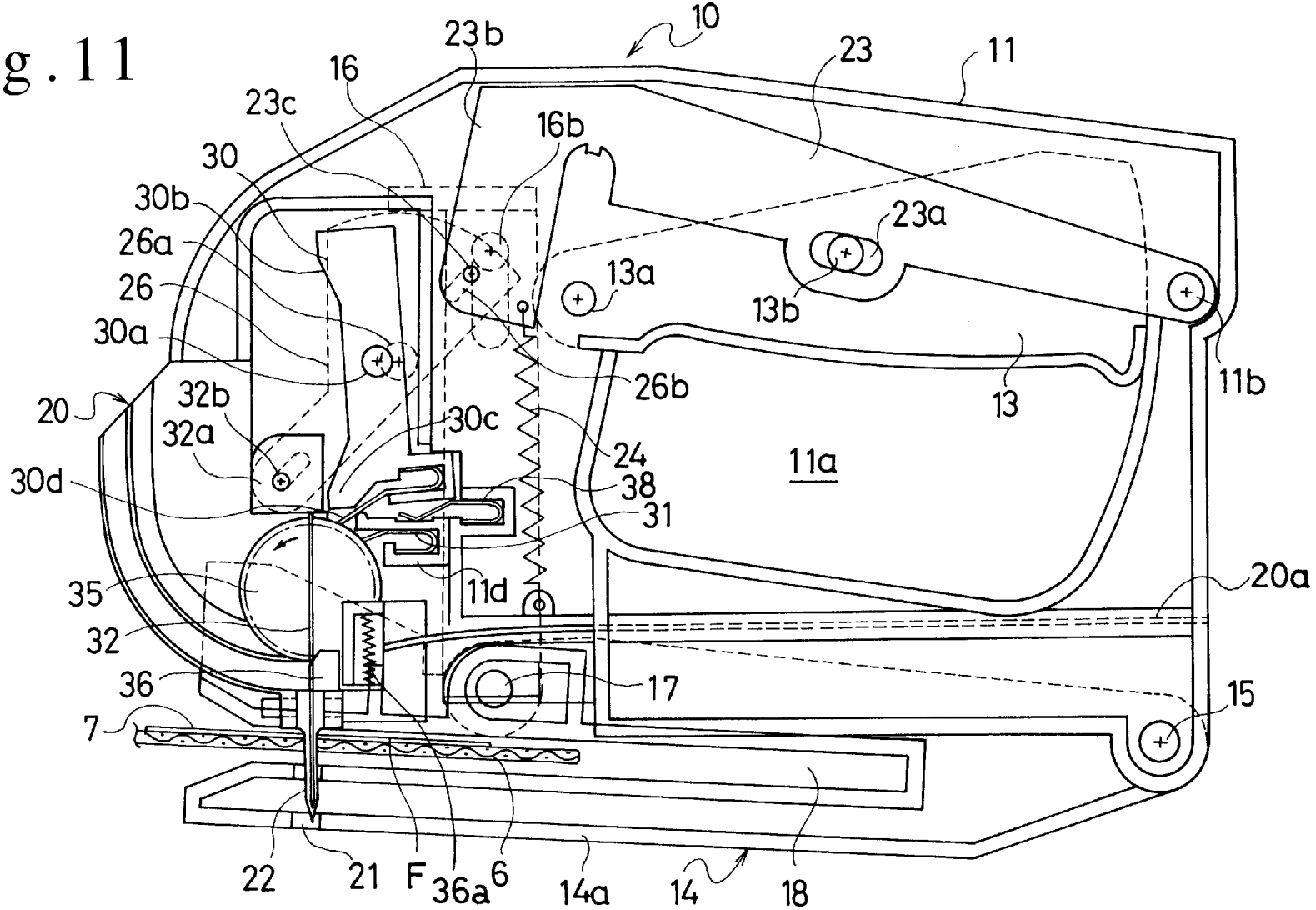
FIG. 11 is an operational illustration of a securing-piece attaching apparatus showing a state in which a securing piece is driven.

(b) Then, as shown in FIG. 11, an object 6 to be worked such as a Jean and an object 7 to be fixed such as a label to be attached to the object 6 are overlapped each other and under this state, inserted into the acceptance port 18 of the support table 14 and supported onto the bottom support table 14*a*.

(c) Then, by holding the rear of the lever 13 protruding into the window 11*a* of the body 11, the L-shaped lever 23 connected with the lever 13 by the spindle 13*b* rotates clockwise about the spindle 11*b*.

Then, the rod lever 26 engaged with the pin 23*c* provided for the lateral of the L-shaped portion 23*b* formed at the front end of the lever 23 through the slot 26 *b* provided for the rod lever 26 rotates counterclockwise about the spindle 26*a* and moreover, raise the connective rod 16 engaging with the top margin 26 *d* of the rod lever 26.

The front of the support table 14 connected to the bottom end of the connective rod 16 rises about the spindle 15 and the hollow needles 22 and 22 enter the needle hole 21, which is opened in the support table 14 passing through the object 6 to be worked and the object 7 to be fixed. This state is carried out by a series of operations changing from the state in FIG. 7 to the state in FIG. 11.

(d) Moreover, because the rod lever 26 and the piston 32 are connected to each other through the slot 26*c* and the pin 32*b*, the pin 32*b* lowers in accordance with the counterclockwise rotation of the rod lever 26 to insert the transverse rod portion 1 of the securing piece p into the hollow needle 22 by the front end of the piston 32. Thus, the cam 30*c* of the oscillator 30 is pressed by the substrate 32*a* at the final stage of advancement of the piston 32 to rotate the oscillator 30 counterclockwise as shown in FIG. 11.

The feed pawl 30*d* provided for the bottom of the oscillator 30 moved in the opposite direction to the forward rotational direction of the feed gear 35. Though the moving distance of the feed pawl 30*d* is slightly larger than one securing piece p, that is, one pitch, the moving distance can be also a value close to this one pitch.

Advancement of the pistons 32 and 32 presses the transverse rod portions 1 and 1*a* of the securing piece p waiting at the entrances of the hollow needles 22 and 22 to advance the portions 1 and 1*a* through the hollow needles 22 and 22, passes the object 6 to be worked and the object to be fixed 7 as shown in FIG. 2, positions the connective rods 1 and 1*a* at the back of the object 6 to be worked, and sets the object 7 to be fixed onto the object 6 to be worked.

(e) By releasing the force holding the lever 13 after completing the setting of the securing piece p under the state in FIG. 11, the lever 13 23 and the connective rod 16 pulled by the lever 13 and spring 24 interlock with the support table 14 to return from the driving state in FIG. 11 to the driving preparation state in FIG. 7.

During the above returning operation, the rod lever 26 rotates clockwise, the substrate 32*a* of the piston 32 rises and contacts the upper-side cam 30*b* of the oscillator 30, and the oscillator 30 is rotated from the state in FIG. 11 to the state in FIG. 7. In accordance with the rotation of the oscillator 30, the pawl 30*d* advances, and the gear 35 engaging with the pawl 30*d* advances the securing piece p by one pitch and the next securing piece p to a driving position.

Because the feed pawl 30*d* and the stopper 31 engage with the feed gear 35, it is impossible to rotate the feed gear 35 when the feed pawl 30*d* returns from the feed state in FIG. 11 to the basic state in FIG. 7. Moreover, a cutter 36 is set to the root of A the hollow needle 22 so as to cut the connective portions 3 and 3*a* arranged between the connective rods 4 and 4*a* and the transverse rod portions 1 and 1*a* when the feed gear 35 rotates to feed the securing piece p.

The extended portion of the cutter 36 can be replaced by being pressed by a spring 36*a*. Moreover, an ejection path 20 *a* for the connective members 4 and 4*a* is formed behind the cutter 36, through which the connective members 4 and 4*a* separated from the securing piece group P by driving the securing piece p are successively guided and ejected.

(f) To remove the securing piece group P from the attaching apparatus 10, by moving a release button 37 provided for the lateral of the body 11 shown in FIG. 4 upward as shown by the arrow in FIG. 4, the spring chamber 11*d* connected to the release button 37 is raised and thereby, the stopper 31 rises and separates from the feed gear 35 and simultaneously raises the feed pawl 30*d* by the front end of the spring chamber 11*d* to separate the pawl 30*d* from the feed gear 35. Therefore, the feed gear 35 freely rotates and under this state, it is possible to remove the securing piece group P from the loading port 20.

Moreover, by releasing the release button 37, the spring chamber 11 *a* become free and returns to its original position by the elastic force of a spring 38, and the feed pawl 30*d* and the stopper 31 engage with the feed gear 35 so that the feed gear 35 rotates only in a predetermined securing-piece feed direction.

(g) As shown in FIG. 5, the loading port 20 of the securing piece group P is formed into a shape to which a normal securing piece group comprising one transverse rod portion and a filament portion and a double-rod-type securing piece group in which a transverse rod portion is set to the both ends of a filament portion respectively can be loaded. When using the normal securing piece group, it is possible to put a plurality of dresses together by attaching a normal securing piece or securing a price tag to a dress.

When using the securing piece group P, as shown in FIGS. 1 and 2, it is possible to attach the securing piece p to a jean or the like as if the piece p is sewed on the jean or the like because the two transverse rod portions 1 and 1*a* and the filament portion 2 for connecting the portions 1 and 1*a* each other move through a path forming the loading port 20 having a bone-like opening comprising transverse lines a, b, and c and a longitudinal line d and a path excluding the central transverse line b, the connective portions 3 and 3*a* are engaged with two feed gears 35 and 35, and two pistons 32 and 32 simultaneously advance to insert the transverse rod portions 1 and 1*a* into two hollow needles 22 and 22 at the same time and eject them from the opening at the front end.

When using a normal securing piece assembly having one transverse rod portion, it is possible to drive the securing piece assembly by passing the head of the assembly through the central transverse line b among the tree transverse lines a, b, and c, a transverse rod portion through either of the transverse lines a and c, and a filament portion through the longitudinal line d. In the case of a normal securing piece, a combination between the transverse line a or c and the transverse line b is used. Therefore, because the head is guided to the transverse line b and the transverse rod portion is guided to the transverse line a or c, it is possible to use only a considerably short filament portion for the securing-piece attaching apparatus.

In the case of the above embodiment, a case is described in which the loading port 20 for loading a securing piece group is opened above the front of the body 11. However, the loading port 20 is opened not only above the front but also in other direction such as in the direction from the rear to the front of the body, in the direction from the bottom to the front of the body, or at the lateral of the body. Thus, the position is determined by considering the design and operability.

Though not illustrated in detail, a case may occur in which two transverse rod portions 1 and 1*a* do not simultaneously reach the entrances of the hollow needles 22 and 22. Therefore, in this case, it is necessary to adjust the securing piece group P by taking it in and out. To omit this operation, it is also possible to adjust rotation by a differential gear when setting the differential gear between two feed gears 35 and 35 and applying a load to one feed gear 35 but applying no load to the other feed gear 35.

Moreover, it may be necessary to adjust the securing piece group P when the securing piece group P or securing piece p is caught by a path for feeding the securing piece group P or a path in which the piston 32 moves or the piston 32 is not smoothly moved. In this case, to easily take out the securing piece group P or adjust various members, it is effective to form these members into a block or open a window at a certain portion of these members.

Furthermore, it is possible to omit one of two connective rods 16 used and one of two rod levers 26 used or omit one of two feed gears 35 used depending on the design.

As described above, a securing-piece attaching apparatus of the present invention is constituted so as to simultaneously drive two transverse rod portions 1 and 1*a* of a securing piece p having the transverse rod portions 1 and 1*a* at the both ends of a filament portion 2 through hollow needles 22 and 22 while supporting a lever 13 so that the lever 13 approaches or separates from a grip portion 12 formed on a body 11, journaling one end of a support table 14 having a bottom support table 14*a* to the bottom of the body 11, and making the support table 14 approach or separate from the body 11 by interlocking with the lever 13, and moreover inserting two hollow needles 22 and 22 provided for the bottom of the body 11 into two needle holes 21 and 21 opened in the bottom support table 14*a*.

Therefore, by efficiently driving the securing piece p having the transverse rod portions 1 and 1*a* at the both ends of the filament 2 into a commodity such as a jean or a sheet-like object as if operating an automatic nailing machine, it is possible to attach a label or the like to the jeans or the sheet-like object.

Moreover, by providing the support table 14 to the bottom of the body 11, inserting a commodity such as a jeans overlapped with a label into the acceptance port 18 of the support table 14 and operating the lever 13, it is possible to drive and fix the securing piece p having two transverse rod portions 1 and 1*a*. Therefore, the operation for driving the securing piece p is easy and moreover, it is possible to efficiently secure a sheet-like object such as a label to a thick commodity such as a Jean or leather product or a sheet-like object.

What is claimed is:

1. A securing-piece attaching apparatus for simultaneously driving two transverse rod portions of a securing piece having a transverse rod portion at both ends of a filament portion, said apparatus comprising:

a body having a grip portion, hollow needles mounted in parallel on a forward end of said body, each needle having an entrance, a lever pivotally mounted on said body to pivot about a first axis positioned toward the forward end of said body so as to approach or separate from said grip portion formed on said body, a support table having a U-shape which includes one end, a front side opposite to said one end, and a bottom support table extending from said one end to said front side below said body, said one end being pivotally mounted at a bottom of the body and rotatable about a second axis parallel to said first axis, making the front side of the support table approach and separate from the body, said bottom support table having needle holes therein aligned with said hollow needles, and means in said body interlocking the lever and said support table, for inserting the hollow needles through an object in said U-shape of said support table and into said needle holes in the bottom support table and for driving said transverse portions through said hollow needles and into the object, wherein a loading port for loading a securing piece group is opened above a front of the body, a guiding path extends from the loading port up to the entrances of hollow needles constituted so as to guide the securing piece group through a curved-surface path formed at the front of the body up to the entrances of hollow needles, and an ejection path extends from said hollow needles to a rear of the body for guiding a connective member left after the securing piece has been driven.

2. The securing-piece attaching apparatus according to claim 1, wherein said means includes:

an oscillating lever operatively connected to said lever, and two pistons connected to said oscillating lever to advance simultaneously so as to simultaneously drive two transverse rod portions arranged at both ends of the filament portion through the hollow needles.

3. The securing-piece attaching apparatus according to claim 1 or 2, wherein a securing-piece driving mechanism can drive any one of a securing piece having a head at one end of a filament and one transverse rod portion at another end of the filament and a double-rod-type securing piece having a transverse rod portion at the both ends of a filament portion respectively.

4. A securing-piece attaching apparatus for driving a securing-piece having a transverse rod portion at both ends of a filament portion, said apparatus comprising:

a body having a grip portion, at least one hollow needle mounted on a forward end of said body and having an entrance, a hand lever pivotally mounted on said body to pivot about a first axis positioned toward the forward end of said body so as to approach or separate from said grip portion formed on said body, a support table having a U-shape which includes one end, a front side opposite to said one end, and a bottom support table extending from said one end to said front side below said body, said one end being pivotally mounted at a bottom of the body and rotatable about a second axis parallel to said first axis, said bottom support table having at least one needle hole therein aligned with said at least one hollow needle, a securing piece driving mechanism in said body including an oscillating lever interlocking with the hand lever, rod levers interlocking with the oscillating lever, pistons interlocking with the rod levers, feed gears provided in parallel with moving paths of the pistons, an oscillator to be oscillated at the raised and lowered positions of the pistons, feed pawls having one end secured to the oscillator and another ends engaged with the feed gears, and stoppers for preventing the feed gears from reversing, and means in said body interconnecting said hand lever and said support table, for inserting said at least one hollow needle through an object in said U-shape of said support table and into said at least one needle hole in the bottom support table at the same time as the securing piece driving mechanism drives the transverse rod portion of the securing piece through said at least one hollow needle and into the object, wherein a loading port for loading a securing piece group is opened above a front of the body, a guiding path extends from the loading port up to the entrance of the at least one hollow needle constituted so as to guide the securing piece group through a curved-surface path formed at the front of the body up to the entrance of the at least one hollow needle, and an ejection path extends from the at least one hollow needle to a rear of the body for guiding a connective member left after the securing piece has been driven.

* * * * *